US005245772A

United States Patent [19]

Girardot

[11] Patent Number: 5,245,772

[45] Date of Patent: Sep. 21, 1993

[54] DISPLAY DEVICE

[75] Inventor: Claude Girardot, Chabeuil, France

[73] Assignee: Girapub, Chabeuil, France

[21] Appl. No.: 707,799

[22] Filed: May 30, 1991

[30] Foreign Application Priority Data

May 31, 1990 [FR] France ..... 90 07045

[51] Int. Cl.[5] ..... G09F 11/02

[52] U.S. Cl. ..... 40/473

[58] Field of Search ..... 40/473, 475, 606, 440; 292/201; 403/325, 330; 474/134; 160/135

[56] References Cited

U.S. PATENT DOCUMENTS

| | | | |
|---|---|---|---|
| 543,906 | 8/1895 | Spaulding | 160/135 X |
| 928,990 | 7/1909 | Lawson | 40/473 |
| 1,238,960 | 9/1917 | Torrey | 40/473 |
| 2,274,047 | 2/1942 | Derman | 160/135 X |
| 2,855,037 | 10/1958 | Stiffel | 160/135 |
| 3,517,905 | 6/1970 | Nestegard | 40/606 X |
| 3,755,936 | 9/1973 | Terre et al. | 40/473 |

FOREIGN PATENT DOCUMENTS

| | | | |
|---|---|---|---|
| 3703150 | 8/1988 | Fed. Rep. of Germany . | |
| 1261839 | 4/1961 | France . | |
| WO87/07744 | 12/1987 | World Int. Prop. O. | 40/473 |

*Primary Examiner*—Kenneth J. Dorner
*Assistant Examiner*—J. Bonifanti
*Attorney, Agent, or Firm*—Oliff & Berridge

[57] ABSTRACT

The present invention relates to a display device of the type for displaying advertising.

In accordance with the invention, the device comprises a stand, a revolving support mounted in rotation on the stand, and a plurality of display panels, which are arranged in rotation on the revolving support about an individual axis parallel with the axis of the stand. According to the invention, the individual axis of each display panel is offset with respect to the median point according to the width of the panel.

13 Claims, 5 Drawing Sheets

DISPLAY DEVICE

BACKGROUND OF THE INVENTION

The present invention relates to display devices or systems, in particular for displaying advertising.

DESCRIPTION OF THE PRIOR ART

In accordance with the document DE-A-3,703,150, a display device is known which has, generally speaking, a vertical axis of symmetry, comprising a fixed support consisting of two horizontal frames of hexagonal profile, which are mounted one above the other in a mutually confronting manner, and six display panels, which are distributed over the periphery of the support, and are each arranged vertically in a rectangular opening formed by two superposed sides of the support and in parallel with the axis of symmetry. Each panel is mounted in first-side/second-side rotation on the support, about an individual axis of rotation, parallel with the axis of symmetry, and arranged along a vertical side of the rectangular opening closed off by said panel. A rotary lower platform comprising six guide channels, each interacting with a stud provided below the lower side of each panel, makes it possible to drive said panels in rotation about their individual and respective axes of rotation while synchronizing their respective rotations so as to cause them to pivot at the same time in the same first-side/second-side or second-side/first-side direction.

According to this document, the rotation of each panel is effected inside the support and by sweeping over a cylindrical surface area whose radius is equal to the complete width of said panel. Consequently, the cylindrical volume circumscribing the support of hexagonal horizontal section must have a diameter of at least twice the width of a panel. In the case of a given size or volume of the display device, provision must be made for panels of relatively limited width, or in the case of panels of a given width, it is necessary to envisage a display device having a relatively large size.

If such a disadvantage can be tolerated for a compact display device, such as those which are encountered in a shop window, it is, on the other hand, unacceptable for a display device of much larger size, such as those which are employed for advertising purposes in the open and comprise, for example, display panels each having a surface area in the region of approximately ten square meters.

SUMMARY OF THE INVENTION

The subject of the present invention is thus a solution and, more precisely, a particular arrangement of the panels with respect to their support, making it possible to limit to a large extent the size in terms of volume and, in particular, according to its horizontal section, of a display device, and to do so on the basis of a given size of the display panels, especially of a given width of the latter.

According to the present invention, in combination:

the individual axis of rotation of each display panel is offset with respect to the median point according to the width of said panel, in such a manner as to form in the latter a relatively narrow section and a relatively wide section which are arranged on either side of said individual axis of rotation, the gap separating the axis of the support and each individual axis of rotation of a panel is adjusted so as to permit solely the passage in rotation of the narrow section of the display panels, in the direction of rotation providing the first-side/second-side or second-side/-first-side inversion of a given panel.

The solution according to the invention makes it possible to limit the working volume of the display device in proportion to the narrow section selected or adopted for each panel, on the basis of the distance separating the axis of symmetry of the support with respect to the median point or axis of symmetry of each said panel.

Thus, in the case of a display device comprising three first-side/second-side rotary rectangular panels whose height is 3.20 m and whose width is 4.20 m:

prior to the invention, that is to say when the axis of rotation of each panel coincides with its axis of symmetry according to the width, the support had an overall radius of 3 m 34.

According to the invention, that is to say when the axis of rotation of each panel is offset with respect to the axis of symmetry according to the width, the support has an overall radius of 2 m 71.

The space saving obtained according to the invention therefore appears significant.

The solution according to the present invention appears to be particularly well suited to the case where the support equipped with the various rotary panels is mounted in a revolving manner, that is to say in rotation, about the axis of symmetry of said support with respect to a fixed stand or mount, since in this case it is precisely the cylindrical volume circumscribing the support which determines the size of the display device.

In addition, the solution according to the invention is even more suited to the case where the revolving support is mounted at the top of a mast, and about the axis of the latter, because in this case the first-side/second-side or second-side/first-side individual rotation of the panels can be carried out freely in respect of the external clearance of the wide section of said panels.

"Width" and "height" of the panels, irrespective of the shape of the latter, are understood as meaning the dimension of said panel orthogonal to the axis of symmetry of the support and the dimension of said panel parallel with said axis respectively.

BRIEF DESCRIPTION OF THE DRAWINGS

The present invention is now described with reference to the accompanying drawings, in which.

DESCRIPTION OF THE PREFERRED EMBODIMENTS

Figure 1:
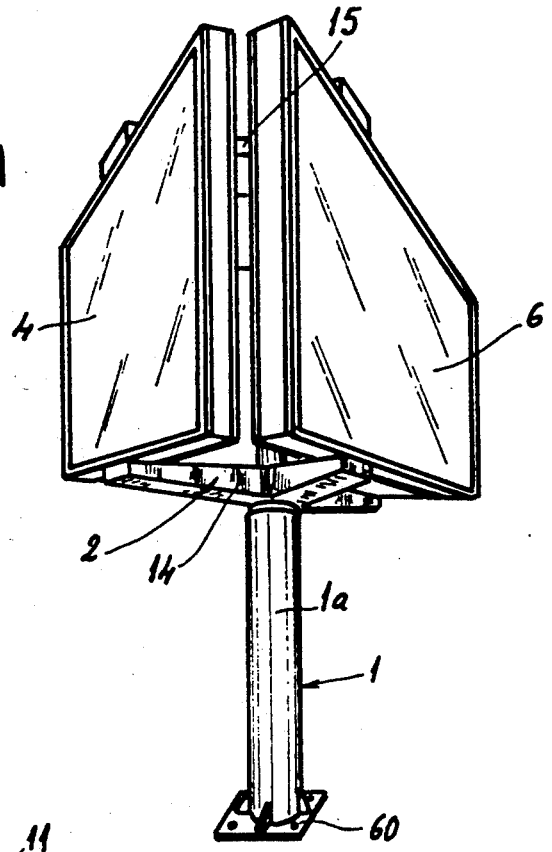
FIG. 1 shows an overall perspective view of a display device in accordance with the present invention.

In accordance with the present invention, a display device according to the invention comprises principally:

a stand or mast 1, fixed on the ground by a suitable base 60, this stand comprising two sections, a lower one 1*a* of relatively large diameter and an upper one 1*b* of smaller diameter, serving as a swivel, a revolving support 2, mounted in rotation on the upper part 1*b* of the stand 1, about the axis of the latter, this support comprising two plates 14 and 15 extending radially, an upper one 15 and a lower one 14, three display panels 4, 5 and 6, arranged as a triangle about the axis 3, and consequently distributed in a uniform manner over the peripheral trajectory of the support 2; each panel 4, 5 or 6 is mounted in rotation on the support 2, between the two plates 14 and 15 which are arranged heightwise on either side of said panel, a means 10 for driving each display panel 4, 5 or 6 in rotation.

Figure 2:
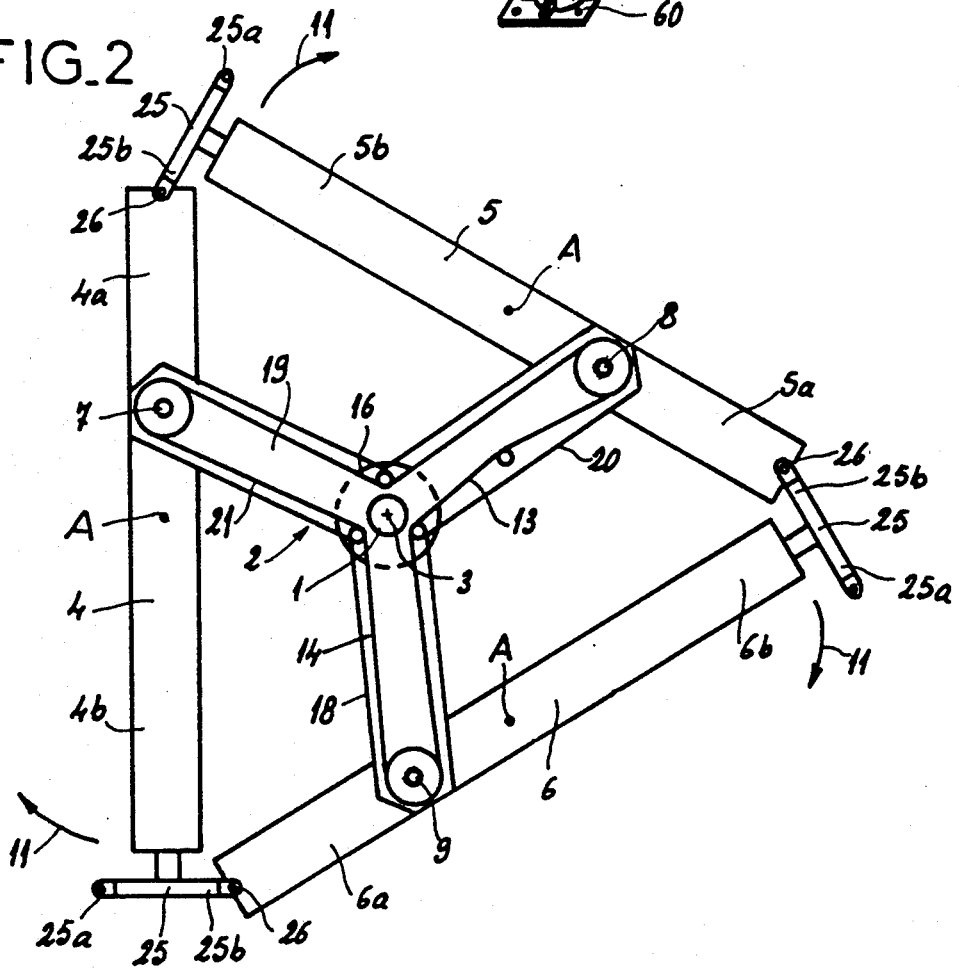
FIG. 2 is a diagrammatic representation in plan view of the display device according to FIG. 1, with the various display panels in the first-side position.

As regards each display panel, for example the panel 4, it revolves about an individual axis of rotation parallel with the axis 3 of the stand 1 and represented in concrete terms by the axis of the tubular support 57, described hereinafter in respect of the frictional security mechanism shown in FIG. 4. The individual axis of rotation of the panel 4 is offset with respect to the median point A according to the width of the same panel in such a manner as to form in the latter a relatively narrow section 4*a* and a relatively wide section 4*b*, which are arranged on either side of the individual axis of rotation of said panel. As is shown in FIG. 2, the gap separating the axis 3 of the stand 1 and each individual axis of rotation of a display panel, for example that of the panel 4, is adjusted so as to permit solely the passage in rotation of the narrow section, for example, 4*a*, of the same panel, either in the direction of rotation 11, that is to say from the first-side position towards the second-side position, or in the direction of rotation 12, that is to say from the second-side position towards the first-side position, which two directions have been shown in FIGS. 2 and 3 respectively. The synchronizing means 13 described hereinafter are used in combination with the various means 10 for driving in rotation, assigned to the various display panels 4, 5 and 6 respectively, so as to drive the latter in rotation, at the same time and in succession, in the direction of rotation 11 towards the first-side position, and in the direction of rotation 12 towards the second-side position according to FIGS. 1 and 2 respectively.

By virtue of these means, which give a general definition of the present invention, the rotation of each display panel takes place, in the case of its relatively wide section, for example 4*b*, outside the imaginary space delimited the rotation of the revolving support 2, and, in the case of its relatively narrow section, for example 4*a*, inside this same imaginary space. Such a rotation can be carried out without disadvantage, since the revolving support is situated at the top of the stand or mast 1, that is to say out of range of any human presence. By virtue of this arrangement, and as shown in FIGS. 2 and 3, the overall size of the display device remains relatively limited, as is determined essentially by the distance separating the axis 3 of the mast and the individual axis of rotation of each display panel.

Figure 3:
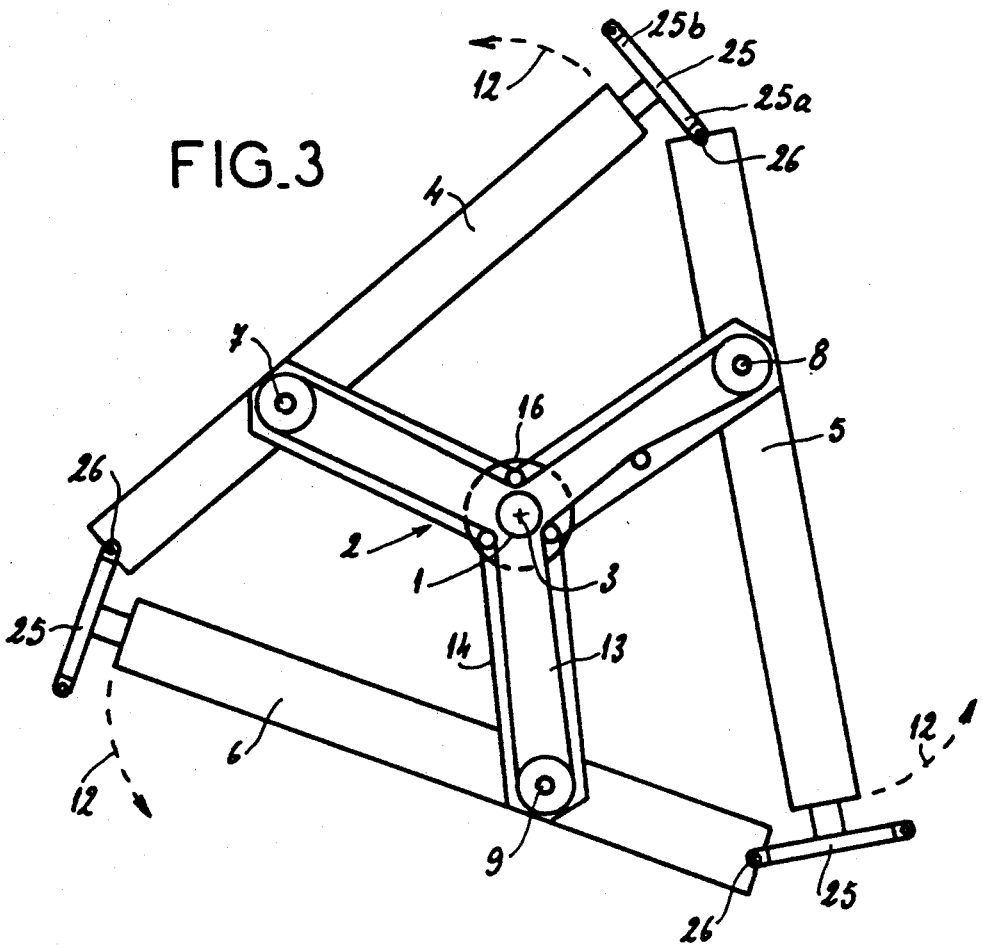
FIG. 3 is also a diagrammatic representation in plan view of the display device according to FIG. 1, with the various display panels in the second-side position.

In accordance with FIGS. 2 and 3, it will be observed that the 3 individual axes of rotation 7, 8 and 9 of the 3 display panels 4, 5 and 6 are arranged in accordance with the vertex of an equilateral triangle having the axis 3 of the mast or stand 1 as its center. To this end, each plate 14 or 15 comprises 3 radial arms 18, 19 and 20, which are arranged at 120° relative to one another and mounted or fixed on a hub 16 or 17, which is mounted in rotation on the upper part 1*b* of the stand 1. The plates 14 and 15 coincide with respect to one another, in such a manner that their respective radial arms are mutually opposite; as a consequence, each individual axis of rotation of a display panel 4, 5 or 6 is arranged between the two ends of two mutually opposite radial arms in such a manner that each individual axis of rotation of a given panel is connected to the two hubs 16 and 17 via three arms 18, 19 or 20.

Figure 4:
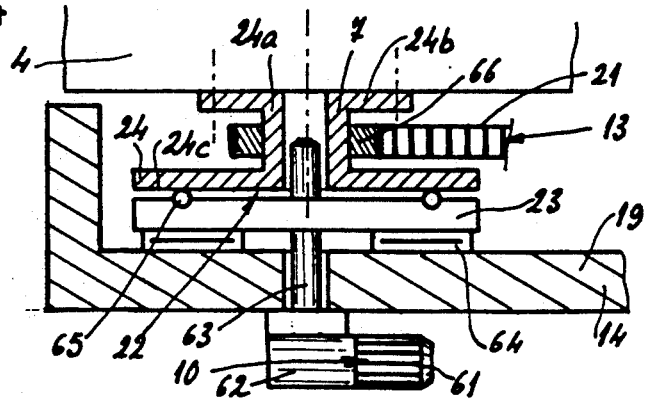
FIG. 4 shows in vertical section the means for driving a display panel in rotation, it being understood that the other two panels of the device according to FIG. 1 are driven in rotation in the same manner.

In accordance with FIG. 4, the means for driving various display panels 4, 5 and 6 in rotation comprise as many individual means 10 as panels. Each individual means 10 is fixed at the free end of a radial arm, 19 for example, and consists in the coupling of a motor 61, a geared unit 62, and a vertical output shaft 63, arranged in parallel with the axis 3 of the stand 1, or along the axis of rotation of the display panel, for example 4, by means of a frictional security mechanism 22, making it possible to uncouple the motor 61 with respect to the same panel, and to do so under the control of the synchronizing means 13 described hereinafter. More precisely, the security mechanism 22 comprises a driving disk 23, which is fixed in rotation on the shaft 63 and arranged flat on the web of the radial arm, for example 19, by means of needle stops 64, and also a driven disk 24, which rests flat on the driving disk 23 by means of a frictional brass retaining ring 65. It is this driven disk 24 which has a tubular part 24*a* which determines the axis of rotation of the display panel, and also a flange 24*b* parallel with the part 24*c* resting on the driving disk 23 and on which flange the display panel is mounted in rotation in an adjustable manner. The means for synchronizing the rotation of the various driven disks 24 is achieved, at each individual means 10 for driving in rotation, by a pinion 66, which is fixed in rotation on the tubular part 24*a* and meshes with an endless chain 21, also shown in FIGS. 2 and 3, the travel of which inside the lower plate 14 is determined by various tensioning devices or other transmission pinions. The profile of the endless chain 21 is similar to the external contour of the three arms 18, 19 and 20 forming the lower plate 14.

By virtue of the arrangements thus adopted, it is possible to drive the various display panel sin rotation, and to do so in the same direction and in a synchronized manner. Any blocking in rotation of any one of the panels brings about the disengaging of each motor 61 with respect to the corresponding individual panel.

Of course, the above-described means ensuring that the various panels 4, 5 and 6 are driven in rotation and synchronized may be achieved differently, for example by the endless chain 21 being driven in rotation by a single component, namely a geared unit or a twin-action hydraulic actuator acting on the chain. Moreover, the use of a hydraulic actuator permits various speeds of rotation of the panels, including a slow speed for the end of the first-side/second-side inversion course of the same panels.

In their first-side and second-side positions, the panels 4, 5 and 6 can be coupled to one another in a positive manner, so as to obtain in each position satisfactory rigidity of the entire revolving support 2. To achieve this, and as shown diagrammatically in FIGS. 2 and 3, each panel at its lower part comprises on the one hand a male coupling member 25 having two opposite joining heads 25*a* and 25*b*, and on the other hand a female joining member 26. Having regard to this arrangement, in the first-side position of FIG. 2 it is the head 25*b* which comes into correspondence with the female member 26 of an adjacent panel, and in the second-side position according to FIG. 3 it is the head 25*a* which comes into correspondence with a female joining member 26.

Figure 5:
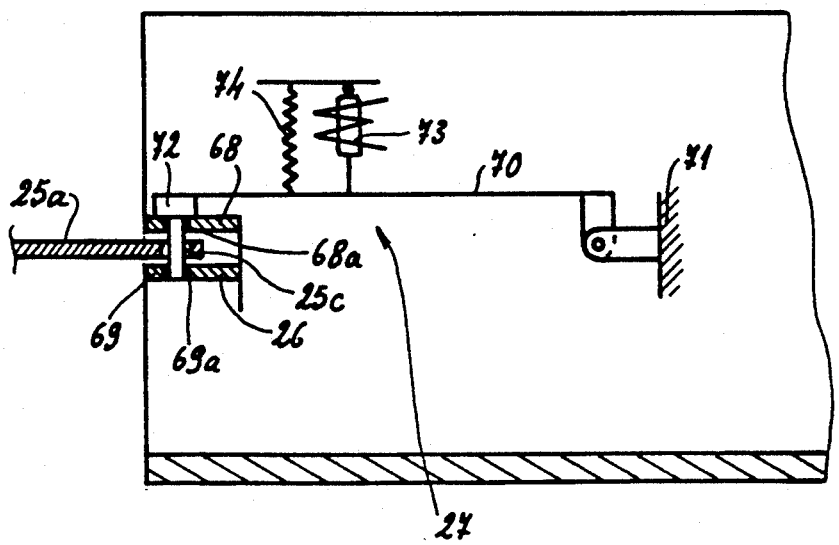
FIG. 5 is a diagrammatic representation in vertical section of the device for coupling two consecutive display panels, both in their first-side position and in their second-side position.

As shown in FIG. 5, in each position in correspondence with a head for coupling with a female joining member, a mechanism 27 makes it possible to lock these two elements to each other according to any suitable procedure. Thus, according to this same FIG. 5, each head 25*a* consists of a flat rod provided at its free end with a slot 25*c*, and each female member 26 consists of two wings 68 and 69, integral with the lower part of a panel 4, comprising two respective coinciding slots 68*a* and 69*a*, and in the gap between which the flat rod 25*a* is inserted; in the insertion position, the slots 68*a*, 25*c* and 69*a* coincide. The locking mechanism 27 comprises a lever 70, mounted in a rotational manner at one end on a fixed part 71, and comprising at its other free end a stud 72 penetrating in the locked position into the alignment of the slots 68*a*, 25*c* and 29*a*. This stud is controlled in the disengaged position by activation of the electromagnet 73 acting on the lever 70, counter to the return means 74, or spring. In the deactivated position of the electro-magnet 73, the return means 74 moves the stud 72 into the alignment of the slots 68*a*, 25*c* and 29*a*, so as to result in the desired locking.

Figure 6:
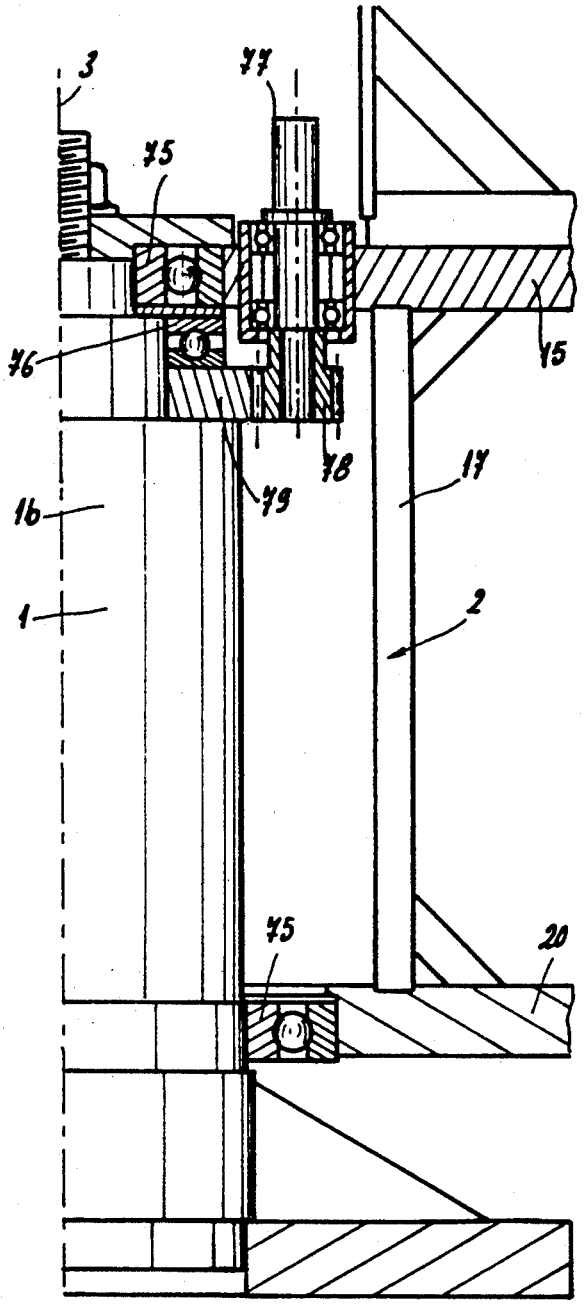
FIG. 6 shows in vertical section the upper plate of the revolving support belonging to the device according to FIG. 1, mounted in rotation on the upper end of the stand of the same device.
Figure 7:
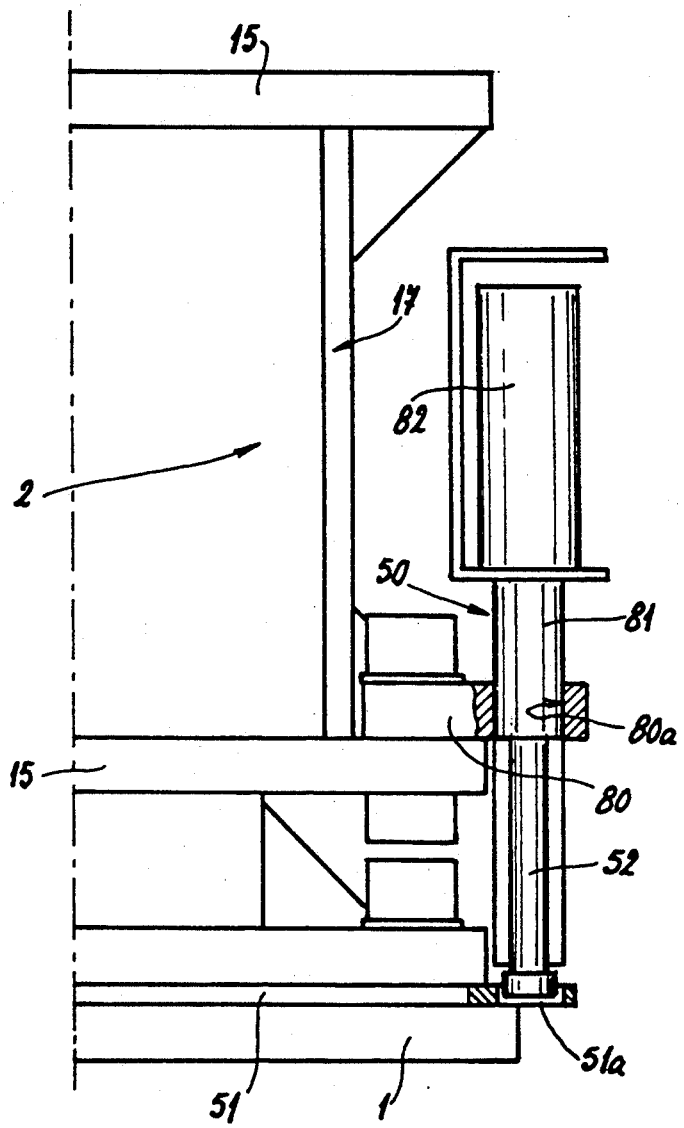
FIG. 7 is a diagrammatic representation in vertical section, still in the region of the upper plate of the revolving support according to FIG. 1, of the means of blocking said supports in rotation relative to the stand or mast.

In accordance with FIGS. 6 and 7, the upper plate 15 is swivelled on the upper part 1*b* of the mast 1, by mounting in rotation of the hub 17 on the part 1*b* by means of axial guiding bearings 75 and a bearing 76 arranged on a shoulder of the part 1*b* and supporting the weight of the revolving support 2. The rotation of the latter is provided by a motor (not shown) mounted on the top of the plate 15 and driving in rotation a shaft 77 which is swivel-mounted on the plate 15 and integral with a lower pinion 78, which meshes with an annular gear 79 fixed on the abovementioned shoulder of the stand 1*b* and on which gear the plate 15 finally rests via the bearing 76.

In accordance with FIG. 7, the display device comprises a means for blocking the revolving support 2 in rotation with respect to the stand 1, this means proving to be particularly useful as described hereinafter for blocking the rotation of said support when the wind speed reaches a certain threshold. This blocking means comprises:

a blocking ring 51, fixed flat on the shoulder separating the lower part 1*a* and the upper part 1*b* of the stand 1, this ring comprising holes 51*a* distributed uniformly over its perimeter, a plate 80 possessing an aperture 80*a*, mounted on the lower part of the hub 17, a guide tube 81, fitted vertically, that is to say in parallel with the axis 3 of the stand 1, into the aperture 80*a* of the plate 80, a control or monitoring device 82 mounted at the top end of the guide tube 81 and consisting of an electromagnet which controls a pin or key 52 opposite the ring 51; this key is controlled by the electromagnet 82, in parallel with the axis 3 of the stand 1, between two positions, namely a top position in which the pin is disengaged from the blocking ring 51, and a bottom position in which, by simple gravity and guided by the tube 80, the pin is engaged in a hole 51*a* of the ring 51.

Finally, the display device is equipped with various monitoring or control components making it possible in particular:

to block the first-side/second-side rotation of the display panels beyond a first wind speed threshold S2, this speed being detected by an anemometer, to block the rotation of the revolving support 2 beyond a second wind speed threshold S1 which is greater than the first threshold S2, which is still measured by the same anemometer.

Figure 8:
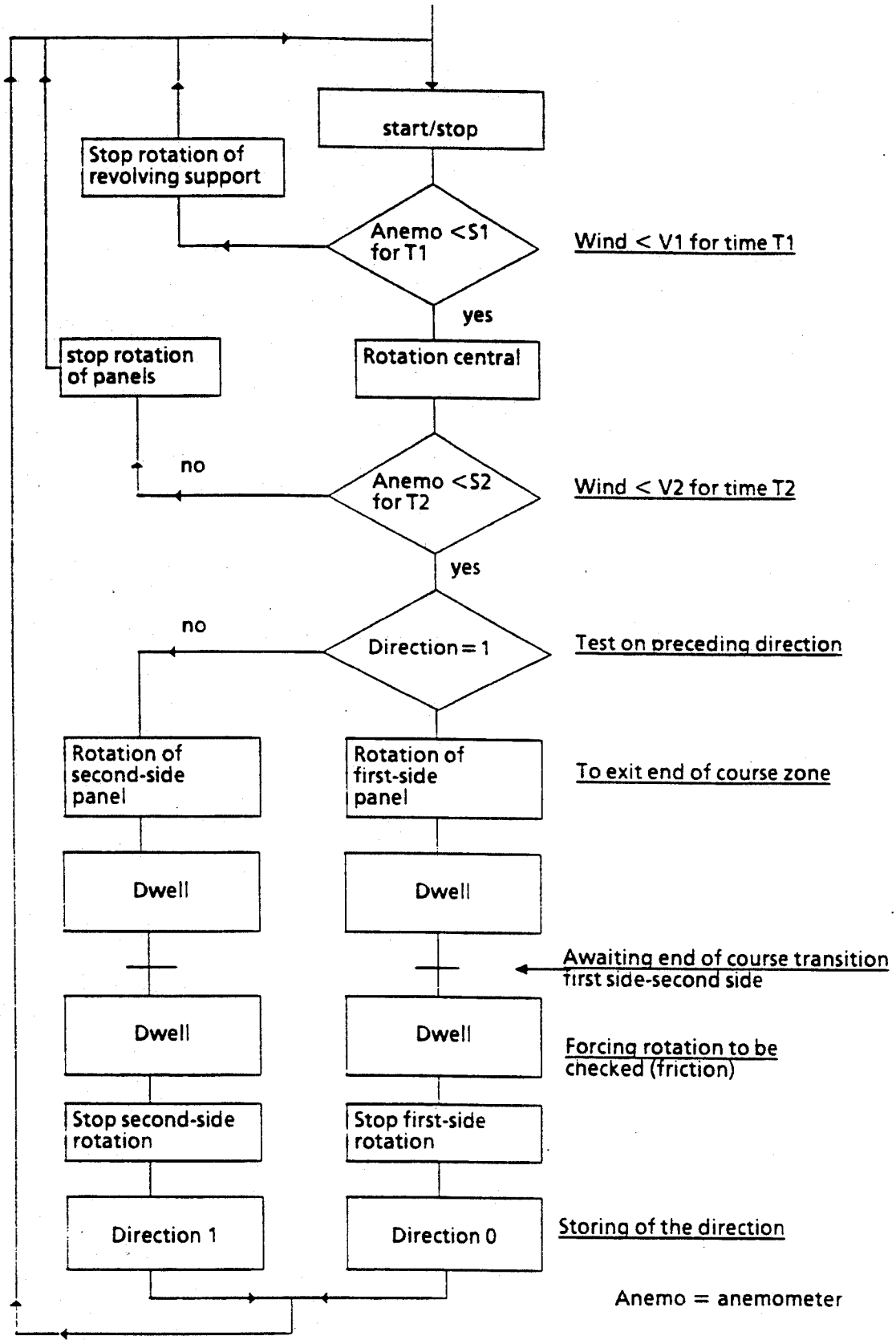
FIG. 8 is a flow chart describing the control or monitoring program for the various functions of the present invention.

To this end, a microprocessor having a control or monitoring program makes it possible for the various functions shown by the flow diagram shown in FIG. 8 to be carried out.

The modifications which follow may be substituted completely or partially for the above-described procedure.

The rotation of the revolving support 2 and the blocking of the latter in rotation with respect to the stand 1 can be achieved, not with separate means as described with respect to FIGS. 6 and 7 respectively, but with a single means. The latter consists of a direct chain drive, with a wheel mounted coaxially on the revolving support and a pinion mounted on the mast or mount of the device; the pinion is driven in rotation by a geared unit having an electromagnetic brake which is actuated in the absence of current and provides both the driving and blocking in rotation of the pinion, and therefore of the revolving support.

In the case of panels whose surface area or dimensions are relatively limited, the device for driving each panel individually in rotation may be replaced by a direct drive, without a frictional security mechanism 22, consisting in moving the endless chain 21 by a single drive means which is unique and common for the three panels; see FIG. 4.

In the case of a display device arranged inside a building, or in an area with little wind exposure, the device for the mutual coupling of the panels described with reference to FIG. 5 can be omitted.

The assembly consisting of the revolving support and the rotary panels has been described and explained for the upper part of a mast or stand. It is evident that the same assembly may be suspended from the lower part of a mast, which is itself fixed at the top part, for example on a ceiling, the abovementioned functional elements remaining unchanged.

I claim:

1. A display device comprising a support having an axis, a plurality of display panels which are distributed over the periphery of the support, each arranged in parallel with the axis of the support and each mounted in rotation on said support about an individual axis of rotation parallel with the axis of said support, a means for driving each panel in rotation, in any direction, with synchronizing means for driving the various panels in rotation at the same time and in the same direction between a first-side configuration and a second-side configuration, the panels adjoining each other in each of said first-side and said second-side configurations to form the same transverse polygonal shape, wherein, in combination:

the individual axis of rotation of each display panel is offset with respect to the median point according to the width of said panel, in such a manner as to form in the latter a relatively narrow section and a relatively wide section which are arranged on either side of said individual axis of rotation, the gap separating the axis of the support and each individual axis is adjusted so as to permit the passage in rotation of the narrow section of the corresponding display panel, in any direction of rotation providing one of the first-side configuration and the second-side configuration, in which the narrow section of one panel adjoins the wide section of an adjacent panel.

2. The device as claimed in claim 1, which comprises three display panels whose individual axes of rotation are arranged according to the vertices of an equilateral triangle having the axis of the support as its center.

3. The device as claimed in claim 1, which comprises a stand, on which the support is mounted in rotation about the axis of said support.

4. The device as claimed in claim 3, wherein the revolving support comprises two plates extending radially which are arranged heightwise on either side of the display panels and each comprise a hub mounted in rotation on the stand and means for connecting the individual axes of rotation of the various panels with said hub.

5. The device as claimed in claim 4, wherein the connecting means consist of a plurality of radial arms fixed on said hub and at the end of which are mounted the individual axes of rotation of the various display panels respectively.

6. The device as claimed in claim 5, wherein the connecting means consist of three radial arms which are angularly equidistant from each other.

7. The device as claimed in claim 3, which comprises a means for blocking the support in rotation with respect to the stand, consisting of a blocking ring having holes distributed over its perimeter and an integral with the stand, a device for controlling a pin, which device is arranged on the revolving support opposite the ring and controls the key in parallel with the axis of the support between two positions, namely a top position in which the key is disengaged from the blocking ring and a bottom position in which, by gravity, the key is engaged in a hole of the ring.

8. The device as claimed in claim 3, which comprises a means for monitoring the rotation of at least one of the revolving support and the display panels, as a function of the wind speed.

9. The device as claimed in claim 8, wherein the monitoring means block the first-side/second-side rotation of the display panels beyond a first wind speed threshold.

10. The device as claimed in claim 9, wherein the monitoring means block the rotation of the revolving support beyond a second wind speed threshold which is greater than the first threshold.

11. The device as claimed in claim 1, wherein the means for driving the various display panels in rotation comprise as many motors as panels, each motor being coupled in rotation to a single and identical display panel, and wherein the synchronizing means comprise an endless chain joining in rotation the various axes for driving the various panels in rotation respectively.

12. The device as claimed in claim 11, wherein each motor is coupled in rotation to a display panel, via a frictional security mechanism making it possible to uncouple the motor with respect to said panel and comprising a driving element and a driven element integral in rotation with said panel, and wherein the endless chain joins in rotation the various driven elements of the various security mechanisms respectively.

13. The device as claimed in claim 1, wherein each panel comprises a male coupling member having two opposite joining heads mounted on one of two laterally opposing ends of said panel, and a female joining member mounted on the other of said two laterally opposing ends of said panel, said members being in combination with a mechanism so as to lock one or the other joining head of a panel with the female joining member of another panel, in the first-side and second-side positions of said panels respectively.

* * * * *